US008540182B2

(12) United States Patent
Martineck, Sr.

(10) Patent No.: US 8,540,182 B2
(45) Date of Patent: Sep. 24, 2013

(54) DISPENSER FOR MULTIPLE ROLLS OF LOTTERY TICKETS

(75) Inventor: Jeffrey D. Martineck, Sr., Alpharetta, GA (US)

(73) Assignee: Scientific Games International, Inc., Alpharetta, GA (US)

( * ) Notice: Subject to any disclaimer, the term of this patent is extended or adjusted under 35 U.S.C. 154(b) by 733 days.

(21) Appl. No.: 11/750,464

(22) Filed: May 18, 2007

(65) Prior Publication Data

US 2008/0283547 A1 Nov. 20, 2008

(51) Int. Cl.
*B65H 49/38* (2006.01)

(52) U.S. Cl.
USPC ..... 242/594.4; 242/594.6

(58) Field of Classification Search
USPC ..... 242/590, 594, 594.4, 594.5, 594.6, 242/597, 597.8, 423, 423.1, 588.6; 206/39, 206/39.6, 389, 399, 408, 409; 221/123
See application file for complete search history.

(56) References Cited

U.S. PATENT DOCUMENTS 469,667 A * 2/1892 Kirby, Jr. ..... 242/594.6
598,752 A * 2/1898 Stephens ..... 242/594.6
601,416 A * 3/1898 Harrison ..... 242/564
919,398 A * 4/1909 Thorton ..... 242/594.6
1,373,797 A * 4/1921 Carr ..... 242/594.6
1,605,145 A * 11/1926 Richards ..... 242/594.6
1,626,574 A * 4/1927 Jackson ..... 242/594.5
2,141,248 A * 12/1938 McCurrach ..... 242/594.4
2,154,440 A * 4/1939 Crotts ..... 242/594.5
2,391,265 A * 12/1945 Palmer ..... 242/594.6
2,425,836 A * 8/1947 Schirrmacher ..... 242/137.1
3,190,004 A * 6/1965 Land et al. ..... 242/594.4
3,771,743 A * 11/1973 De Luca et al. ..... 242/129.8
5,399,005 A * 3/1995 Schafer ..... 206/509
5,702,284 A * 12/1997 Gallegos ..... 248/317
5,944,219 A 8/1999 Emoff et al.
6,082,662 A * 7/2000 Gallien ..... 242/588.6
6,267,263 B1 7/2001 Emoff et al.
6,481,665 B2 * 11/2002 Walker ..... 242/594.6
7,011,381 B2 * 3/2006 Roberts et al. ..... 312/34.4
7,021,493 B2 4/2006 Brickwood
7,025,300 B2 * 4/2006 Glassey ..... 242/588.3

* cited by examiner

*Primary Examiner* — William A Rivera
(74) *Attorney, Agent, or Firm* — Dority & Manning, P.A.

(57) ABSTRACT

A lottery ticket dispensing system includes a housing having a plurality of lottery ticket rolls carried therein. At least one wall of the housing defines a common dispensing face having a respective dispensing slot for each of the lottery ticket rolls. A leading end of each of the lottery ticket rolls is pulled and dispensed independently of the other lottery ticket rolls.

30 Claims, 5 Drawing Sheets

DISPENSER FOR MULTIPLE ROLLS OF LOTTERY TICKETS

FIELD OF THE INVENTION

The present invention relates to a dispenser for lottery tickets, and more particularly to a dispenser for multiple rolls of lottery tickets.

BACKGROUND

Various commercial dispensers are known and widely used in the art for dispensing a supply of interconnected lottery tickets. Typically, the lottery tickets are provided to a commercial establishment in a stack or "brick" of interconnected, fan-folded tickets. The stack of tickets is placed into a compartment of a dispenser that typically holds a plurality of different lottery tickets. For example, a known dispenser includes two side-by-side compartments within the same housing, with multiple dispensers being stacked on each other. These dispensers may be placed on the retail counter, on a shelf, supported on a wall, and the like, typically at the point of check-out. To dispense the tickets, a clerk pulls one or more of the tickets from a respective dispensing slot in the dispenser and tears or otherwise separates the tickets along a pre-formed separation line. The conventional dispensers are typically transparent so that the customer can view their ticket being pulled and separated from the stack of tickets.

There are drawbacks to the conventional dispensers for fan-folded lottery tickets. For example, the most valuable space in a commercial establishment is often the counter space at the point of checkout, which is typically where the lottery tickets are sold and dispensed by the retail clerk. The conventional dispensers for blocks of fan-folded tickets make inefficient use of this valuable space. Because of the folded nature of the block of tickets, the dispenser compartment must be sized so as to accommodate the "throwback" space needed at the top of the stack in order for the tickets to unfold from the stack as they are dispensed. This space is substantial and is essentially wasted, particularly for an industry standard 2" by 4" lottery ticket. The dispensers are thus unnecessarily "tall" relative to the initial stack height of the block of tickets. Stacking of the dispensers on top of each other only exacerbates this problem.

Also, the side-by-side compartment configuration of the conventional dispensers is problematic. When the dispenser is placed on a counter, for example the checkout counter, other items cannot be placed in front of the dispenser without blocking the dispenser from the customer's view. Typically, it is the view of the tickets through the dispenser that serves to advertise the particular lottery game, and it is important that the customers have a clear view of the dispenser and tickets within the dispenser. Thus, although not particularly deep, a dual compartment dispenser takes up a relatively wide and valuable swath of the counter.

Yet another drawback to the conventional dispensers occurs in loading the devices. Such dispensers are typically top loaded and it is often the case that multiple dispensers are stacked on top of each other. To replace a block of tickets in the lowermost dispenser, the upper dispensers must be removed and relocated, which can be a time consuming and troublesome task.

U.S. Pat. No. 7,021,493 to Brickwood describes a disposable single-ticket dispenser for dispensing a single stack of fan-folded lottery tickets. The dispenser is provided in the form of a flat blank of material that can be folded by the retail establishment into the final dispenser form. Graphics or other indicia related to the particular type of lottery game may be printed on the dispenser walls. The dispenser is made of relatively inexpensive material and is discarded after the tickets have been sold. The dispenser is described as having a width and length essentially equal to the dimensions of the lottery ticket. However, the dispenser has a height significantly greater than the stack of folded tickets to accommodate the throwback space needed to unfold and dispense the tickets. Also, establishments typically promote multiple lottery games, which would require multiple ones of the single-ticket dispensers on or around the counter.

Accordingly, a need still exists for a more efficient means for dispensing strips of interconnected lottery tickets.

SUMMARY

Objects and advantages of the invention will be set forth in part in the following description, or may be obvious from the description, or may be learned through practice of the invention.

Embodiments of the invention relate to a lottery ticket dispensing system for dispensing rolls of interconnected lottery tickets. The system is not limited to any particular type or size of lottery ticket, and can be configured for dispensing any size or configuration of rolled lottery tickets. The lottery tickets may be separated by pre-formed perforation lines, although this is not a requirement of the system.

The system includes a dispenser housing having an internal compartment that defines a plurality of lottery ticket roll positions therein between opposite walls of the housing. In a horizontal orientation of the dispenser, the ticket rolls are oriented vertically between the top and bottom walls of the dispenser, and the dispenser has a height corresponding generally to the width of a single full roll of lottery tickets (with allowance for thickness of the housing walls). In a vertical orientation of the dispenser, the ticket rolls are oriented horizontally between sidewalls of the dispenser, and the housing has a width corresponding generally to the width of a single lottery ticket roll (with allowance for thickness of the housing walls).

At least one wall of the housing defines a common dispensing face with a respective dispensing slot defined therein for each of the lottery ticket rolls. For example, if the housing has six roll positions, there will be at least six dispensing slots defined in the dispensing face of the housing. The slots provide a means by which a leading end of each of the lottery ticket rolls is pulled and dispensed independently of the other lottery ticket rolls. A blade or knife-edge may be configured with each slot against which the lottery tickets may be pulled to aid in separation of the tickets. For perforated rolls of tickets, it is only necessary that the tickets be grasped and torn along the perforation lines to be separated.

The dispenser housing may take on any desired shape or configuration. In a desirable space-efficient embodiment, the housing has a generally elongated rectangular block configuration with dimensions dictated principally by the dimensions of a full (i.e., "new") roll of lottery tickets. For example, the lottery ticket rolls may be arranged in at least two or more aligned rows within the internal compartment of the housing. In a horizontal orientation of the housing, the rows are aligned side-by-side with the housing having a depth corresponding generally to the diameter sum of the number of rolls within each row, and a width corresponding generally to the diameter sum of the number of rows. In a vertical orientation of the housing, the rows are vertically aligned and the housing has a height corresponding generally to the diameter sum of the vertically aligned rolls, and a width corresponding to the width of an individual roll of tickets. For instance, the housing may contain two vertically aligned rows of 5-inch diameter rolls (of 4-inch wide tickets) with three rolls in each row. The housing in this embodiment may have a height corresponding generally to about 10 inches and a width of about 4 inches, with allowance being made for the thickness off the housing wall materials and any internal walls. In the same example, the housing may have a depth corresponding generally to the diameter sum of the three rolls in each row, or about 15 inches.

In an alternate embodiment, the lottery ticket rolls may be arranged in at least two or more offset rows (vertically or horizontally offset) within the internal compartment of the housing. For example, the axis of rolls in one row may lie between the axes of the rolls in the adjacent row. Depending on the orientation of the dispenser, this configuration will decrease the height or width of the dispenser housing.

It should be appreciated that the lottery ticket roll positions and respective rolls may be arranged in a vast number of patterns in the housing within the scope and spirit of the invention.

The lottery ticket roll positions may be defined within the housing by various means. In a particular embodiment, walls are provided within the housing to define each of the roll positions. The ticket rolls may simply rest on one of these walls as they are dispensed without the need of additional support structure. Any configuration of internal walls may define each of the roll positions. For the embodiment wherein the rolls are arranged in vertically aligned rows, the sidewalls may have a staggered vertical height increasing from the dispensing face towards an opposite wall of the housing to aid in routing and directing the lines of tickets within the housing. The same type of wall structure may be used with horizontally oriented dispensers.

The rolls of lottery tickets may be formed around a core, or may be coreless. Coreless rolls can be supported within the housing by support wall structure, as discussed above, and are free to rotate at their respective roll positions without additional rotation devices. For cored rolls, a spindle may be provided at each of the roll positions. The plurality of spindles may be mounted to a common wall of the housing and extend in parallel into the internal compartment, with the core of the lottery ticket rolls sliding onto the spindles. In a particular embodiment, the cores are sized to rotate relative to the spindles, in which case the spindles may be rotationally fixed relative to the housing sidewall. Preferably, a sufficient frictional interface exists between the core and stationary spindle to prevent freewheeling of the core and roll upon the leading ticket being pulled from the dispensing slot.

In an alternate embodiment, the cores are engaged with the spindles so as not to rotate relative to the spindles, with the spindles rotating relative to the housing sidewall. The cores may be mounted to the spindles by any suitable means, including mechanical means, adhesives, friction fit, and so forth. With this embodiment, it may be desired to include an adjustable brake mechanism configured between the spindles and the housing sidewall to prevent freewheeling of the lottery ticket rolls upon dispensing thereof. Any manner of brake mechanism may be used, such as a relatively simple mechanical device that adjusts a frictional interface between an end face of the spindle and the housing sidewall. An example of such a device includes a threaded nut and washer combination with a threaded extension of the spindle that extends through the housing sidewall.

In the event that an excessive number of tickets are pulled from any one slot, it may be desired to incorporate a rewind mechanism on an outer face of the housing wall for each of the spindles. This rewind mechanism may be any device that allows the clerk to wind the ticket back onto the roll without having to open the dispenser. Such mechanism may include, for example, a manually graspable tab configured on an extension of the spindles that extends through the housing sidewall. The rewind function may be combined with the brake mechanism discussed above.

The dispenser housing may be made of any one or combination of suitable rigid materials, including a number of low-cost materials such as plastic or paperboard. One or more of the housing walls may be made of a substantially transparent material so that the rolls of lottery tickets are readily visible by the clerk and purchasing customers. In other embodiments, the walls may provide the background for any manner of indicia, graphics, or advertisements. In a unique embodiment, a display window is configured on at least one wall of the housing for receipt and display of any manner of indicia material that may identify or advertise the particular lottery tickets within the housing. This window may be, for example, a transparent sealable pouch attached to the housing, or formed with the housing. It may also be desired to remotely advertise or display any manner of indicia related to the lottery tickets, particularly if the housing is not transparent, or is stored at a location that is not readily visible to the purchasing customer. For example, a placard or other device may be used to remotely display samples of the lottery tickets contained within the housing.

For embodiments wherein the housing is not transparent, it may be desired to include an indicator slot at each of the roll positions, such slot providing a means for external viewing of the decreasing diameter of the lottery ticket rolls as the rolls are dispensed.

It should be appreciated that the invention includes the dispenser described herein as a stand-alone article (i.e., without lottery ticket rolls contained therein).

Reference is made below to particular non-limiting embodiments of the invention depicted in the figures.

DETAILED DESCRIPTION

Reference is now made to particular embodiments of the inventive method and apparatus according to the invention, one or more examples of which are illustrated in the figures. It should be appreciated that the embodiments are provided by way of explanation of the invention, and are not meant as a limitation of the invention. For example, features illustrated or described with respect to one embodiment may be used in another embodiment to yield still a further embodiment. The present invention encompasses these and other modifications and variations made to the embodiments described and illustrated herein.

Figure 1A:
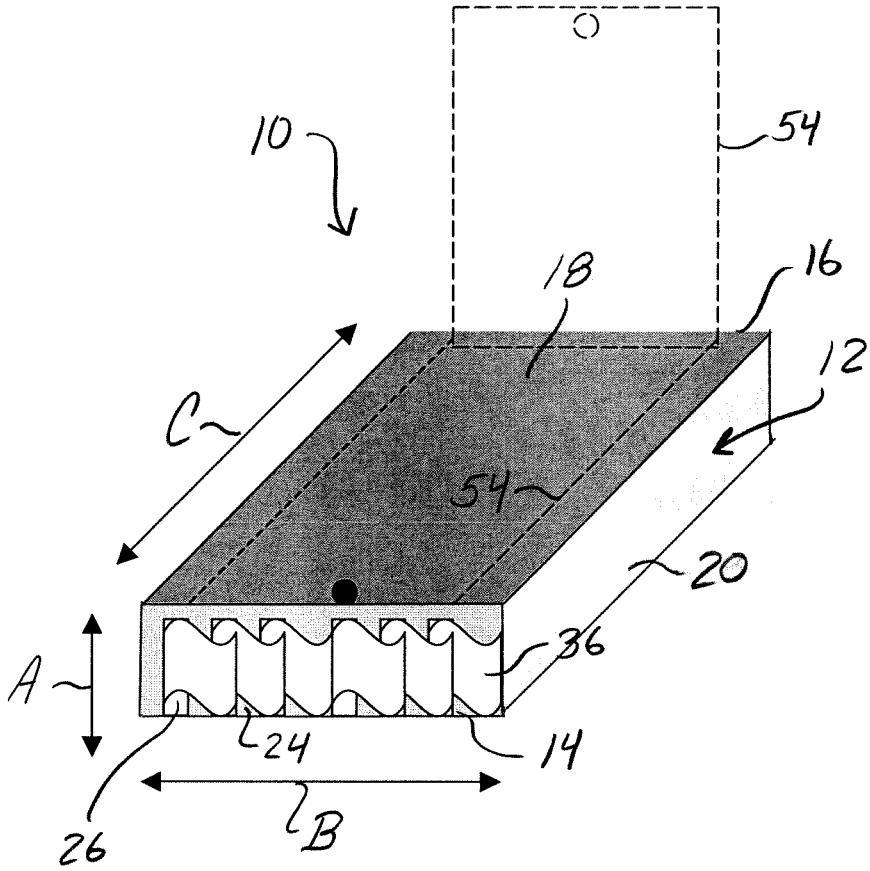
FIG. 1A is a perspective view of a lottery ticket dispenser system for dispensing rolls of lottery tickets in accordance with the invention in a horizontal orientation.
Figure 1B:
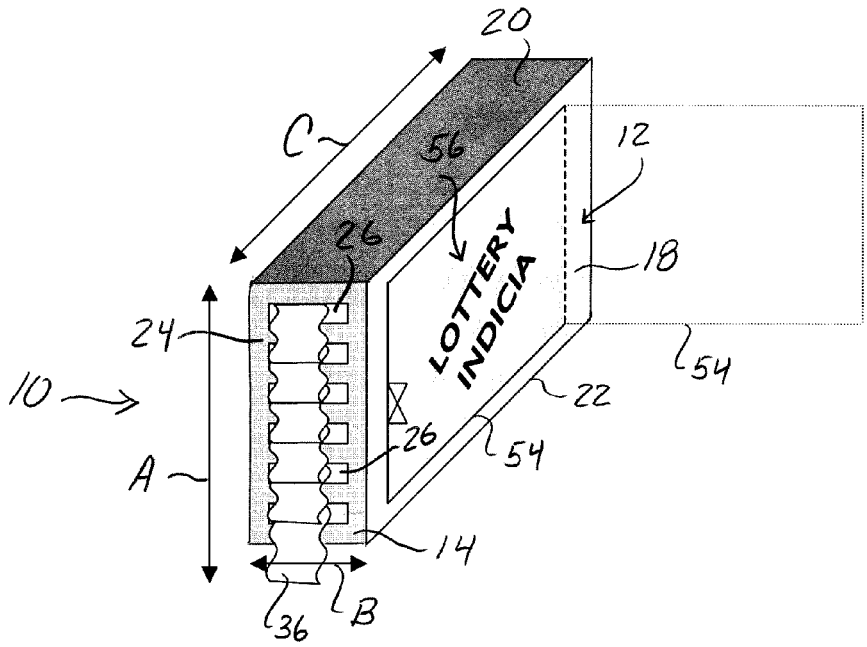
FIG. 1B is a perspective view of a lottery ticket dispenser system for dispensing rolls of lottery tickets in accordance with the invention in a vertical orientation.

Referring to the figures in general, various embodiments of a system 10 for dispensing rolls of lottery tickets are illustrated. The system 10 includes a housing 12 having any desired shape, size, or configuration. In the illustrated embodiments, the housing 12 has a generally rectangular elongated block configuration defined by sidewalls 18 and edge walls 20. In the embodiment of FIG. 1A, the housing has a horizontal orientation with the sidewalls 18 defining top and bottom walls of the housing 12 and defining the width dimension B of the housing 12. In the embodiment of FIG. 1B, the housing has a vertical orientation with the edge walls 20 defining the top and bottom walls and the width dimension B of the housing 12. The housing defines an internal compartment 28 for receipt of a plurality of lottery ticket rolls 34*a*-34*f* therein. The respective lottery ticket rolls are disposed at individual lottery roll positions 32*a*-32*f* within the housing 12. In the illustrated embodiment, each roll position 32*a*-32*f* is defined between opposite sidewalls 18 of the housing 12. Thus, in FIG. 1A, the housing 12 has a height A that corresponds generally to the width of an individual lottery ticket roll and the thickness of the housing walls 18. In FIG. 1B, the housing of FIG. 1A is essentially stood on edge, and the housing 12 has a width B that corresponds generally to the width of an individual lottery ticket roll and the thickness of the housing walls 18. It should be appreciated that the housing 12 may be formed with particular dimensions for the intended type of lottery tickets to be dispensed therefrom.

At least one of the walls of the housing 12, for example one of the sidewalls 18, is hinged and defines a door or cover 54 that provides access to the internal volume 28 of the housing for loading or unloading the lottery ticket rolls, as depicted in FIGS. 1A and 1B.

The housing 12 includes a dispensing face 24 defined by at least one of the walls. In the illustrated embodiment, the dispensing face 24 is defined by a front wall 14. The dispensing face includes a plurality of individual dispensing slots 26 defined therethrough. The dispensing slots 26 have a shape and size so as to accommodate a strip of lottery tickets from respective lottery ticket rolls. For example, referring to FIGS. 1A, 1B, and 2, a leading edge 36*a*-36*f* of the respective lottery ticket rolls extend from individual dispensing slots 26. The leading tickets may be readily pulled by a clerk and torn along preformed perforation lines for dispensing of the tickets. In an alternative embodiment, a knife-edge or blade may be configured with each individual dispensing slot 26 against which the tickets may be pulled or drawn to further aid in separation of individual tickets from the continuous strip of lottery tickets.

Figure 2:
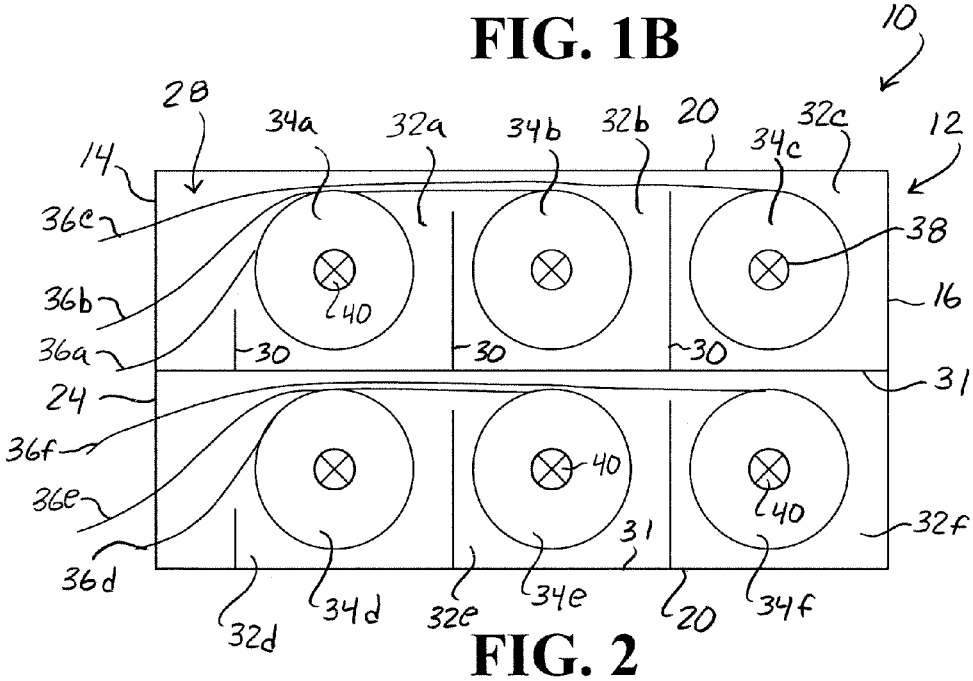
FIG. 2 is a diagrammatic cross-sectional view of an embodiment of a lottery ticket dispenser according to the invention.

The lottery ticket rolls 34*a*-34*f* may be arranged in various configurations within the housing 12. FIG. 2 illustrates an embodiment wherein the lottery ticket rolls are arranged in rows within the internal volume 28 of the housing 12. This configuration may be applied to the horizontal orientation of FIG. 1A, or the vertical orientation of FIG. 1B. Referring to FIG. 2, the rolls are arranged in two aligned rows within the housing 12 such that the axes of the rolls in adjacent rows are aligned. Thus, in the vertical orientation of FIG. 1B, the height A of the housing 12 may correspond generally to twice the diameter of a "full" roll of lottery tickets plus the thickness of the top and bottom walls 20, 22 of the housing 12. In the horizontal orientation of FIG. 1A, the height A corresponding to the width of a single roll and the width B corresponds to generally twice the diameter of a full roll of tickets. With three rolls in each row, as illustrated in FIG. 2, the housing 12 may have a depth C (FIGS. 1A and 1B) corresponding generally to three times the diameter of a full ticket roll plus the thickness of the front and back walls 14, 16. The same analysis applies to the The block-type configuration of the housing 12 illustrated in FIGS. 1A and 1B with vertically or horizontally aligned rows of lottery roll tickets provides an efficient space-saving dispensing system 10. It is believed that the volume of the internal compartment 28 may be used to store and dispense up to six times as many lottery tickets as compared to the volume needed to dispense a comparable number of fan-folded tickets, as with conventional prior art dispensers.

Figure 5:
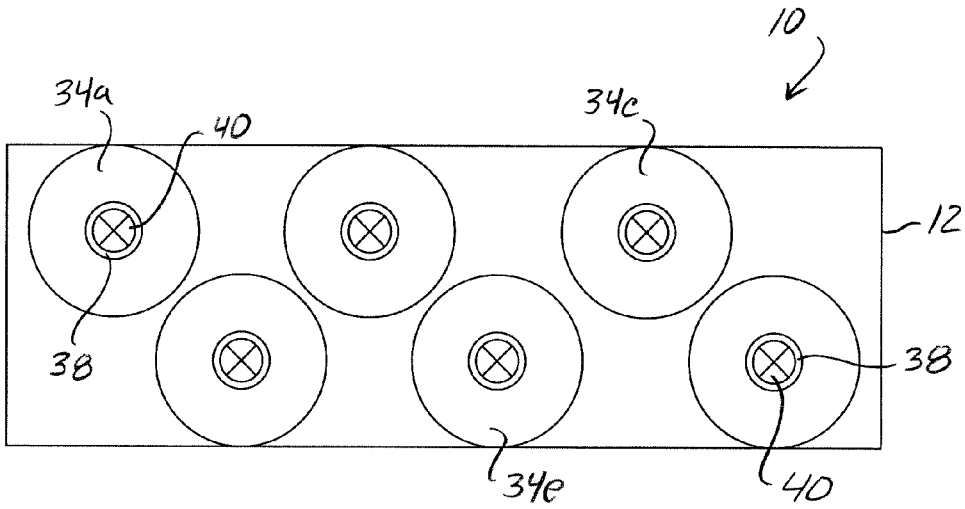
FIG. 5 is a partial cut-away and perspective view illustrating an alternative arrangement of lottery ticket rolls within a dispenser in accordance with an embodiment of the invention.

An alternative arrangement of lottery ticket rolls 34 within housing 12 is illustrated in FIG. 5. In this embodiment, the rows of ticket rolls are offset such that the axis of one roll lies between the axes of two rolls in the adjacent row of rolls. With this particular embodiment and a vertical orientation of the housing 12, the height A of the dispenser is decreased, as compared to the arrangement of vertically aligned rolls illustrated in FIG. 6, and the depth C of the housing 12 is increased, as compared to the vertically aligned arrangement of rolls in FIG. 6.

Figure 6:
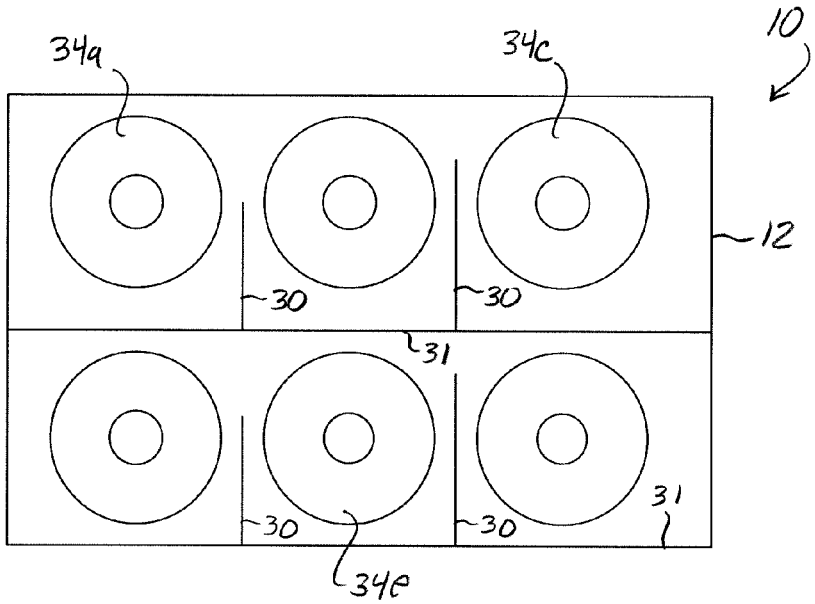
FIG. 6 is a cut-away and partial perspective view of an alternative arrangement of coreless lottery ticket rolls in a dispenser housing in accordance with an embodiment of the invention.

The individual roll positions 32*a*-32*f* within the housing 12 may be defined by various means. For example, referring to FIGS. 2 and 6, internal walls 30, 31 may be used to define individual sub-compartments within the housing 12. In a vertical orientation of the housing 12, the individual rolls 34 may simply rest on the wall 31 as they are unrolled and dispensed, particularly with coreless lottery ticket rolls as illustrated in FIG. 6. In a horizontal orientation of the housing 12, the rolls 34 may rest on the bottom wall of the housing and internal walls 30, 31 may define the individual roll positions 32*a*-32*f*. The walls 30 may also serve to prevent the rolls from being pulled against each other as the leading edge of the respective tickets are pulled from the housing 12 through the dispensing slots 26. The walls 30 may be staggered in height (increasing) in the direction from the front wall 14 towards the back wall 16, as illustrated in FIG. 2. This staggered height relation will provide additional structural guidance for the lottery ticket strips as they are dispensed, particularly as the individual rolls decrease in diameter.

In alternative embodiments, for example as illustrated in FIGS. 2 and 5, the roll positions 32*a*-32*f* may be defined by spindles 40 that extend from one of the sidewalls 18 towards the opposite sidewall. These spindles 40 define individual members upon which the rolls 34 may be placed. In the embodiment of FIG. 5, the individual lottery ticket rolls 34 include a core member 38 that slides onto the respective spindles 40. It should be appreciated, however, that the coreless lottery ticket rolls, such as illustrated in FIG. 6, may also be placed onto and supported by spindles 40. Referring to FIGS. 2 and 5, the cored lottery ticket rolls 34 may include cores 38 that are sized so as to rotate relative to the respective spindles 40. In this case, the spindles 40 may be rotationally fixed relative to the sidewall 18. For example, the spindles in this case may be defined by rods or other members that are adhered or otherwise fixed to the sidewall. Desirably, a sufficient frictional interface exists between the rotating cores 38 and the stationary spindles 40 to prevent freewheeling of the cores 38 and lottery ticket rolls 34 upon the leading ticket being pulled from the housing 12.

In an alternative embodiment, the cores 38 may be attached to the spindles 40 so as not to rotate relative to the spindles. For example, the cores may have a relatively tight friction fit around the spindles 40, or be permanently adhered or otherwise attached to the spindles 40. In this case, the spindles 40 would be mounted so as to rotate relative to the housing sidewall 18 by any conventional means. Although within the scope of the invention, complicated bearing or rotation devices are not necessary for rotation of the spindles 14. For example, the spindles 40 may bear and slide directly against the inner surface of the sidewall 18.

Figure 8:
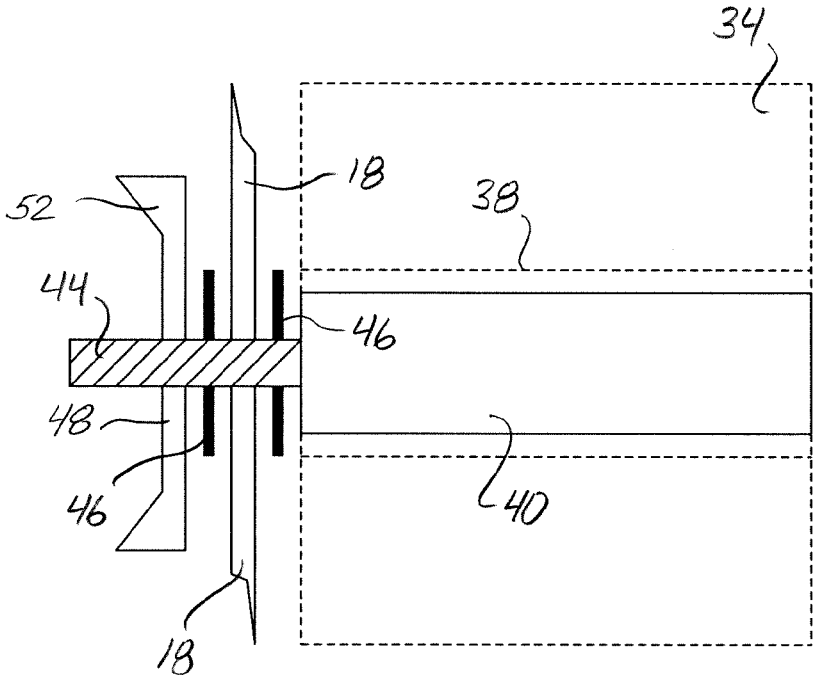
FIG. 8 is a side view of an embodiment of a break mechanism for use with the individual lottery ticket rolls within a dispenser housing.

Referring to FIG. 8, a relatively simple attachment scheme is illustrated for rotational mounting of the spindles 40 relative to the sidewall 18. The spindles 40 include a threaded extension 44 that extends through the sidewall 18. Washers 46 may be provided on either side of the wall 18, and a threaded nut 48 may be used to secure the spindles 40 relative to the sidewall 18.

With the rotatable spindles, it may be desired to include any manner of brake mechanism that limits or prevents freewheeling of the spindles and lottery ticket rolls upon the leading edge of the tickets being pulled from the housing. The brake mechanism may include, for example, a ratchet wheel/tooth arrangement, an eccentric drive, and any other suitable mechanical braking device. In the embodiment illustrated in FIG. 8, the function of a brake may be incorporated with the mechanism for attaching the spindles 40 to the housing sidewall 18. For example, rotational friction between the spindle 40 and housing sidewall 18 may be increased simply by tightening the nut 48 to an extent such that rotation of the spindle 40 is achieved without freewheeling of the spindle.

Figure 3:
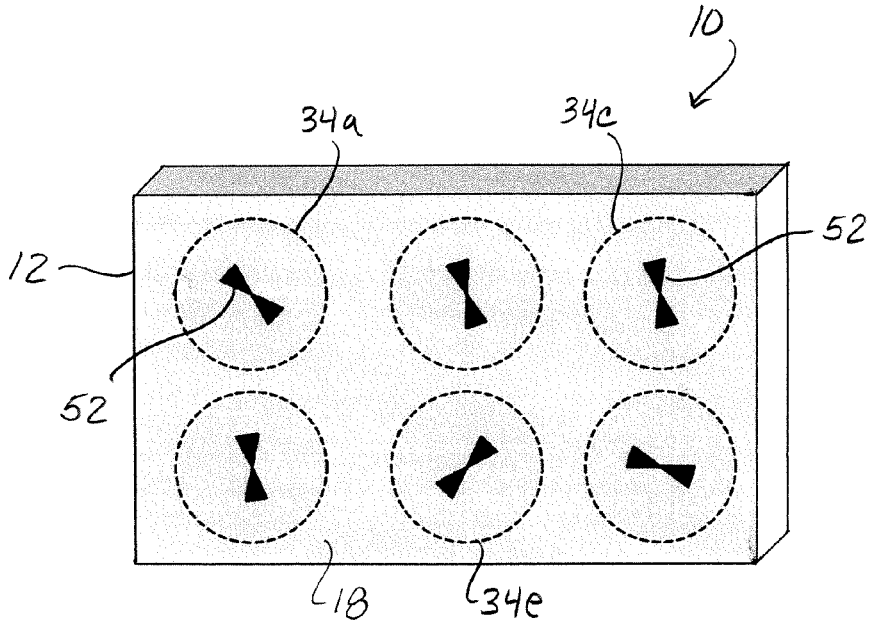
FIG. 3 is a back partial perspective view of an embodiment of a dispenser according to the invention incorporating rewind devices for the individual lottery ticket rolls.

In the event that an excessive number of lottery tickets are pulled from any one of the dispensing slots 26, it may be desired to incorporate any manner of rewind mechanism for each of the lottery ticket roll positions 32*a*-32*f* so that the clerk may wind the tickets back onto the rolls without having to open the dispenser housing 12. FIG. 3 conceptually illustrates a rewind mechanism in the form of a handle or tab 52 configured on the outside surface of the housing sidewall 18. This handle 52 may be attached to an extension of the spindle 40 that extends through the sidewall. For example, referring to FIG. 8, the handle 52 may be a separate member that is attached to the threaded extension 44. Alternatively, the handle 52 may be defined by an extension of the nut 48 such that the rewind and brake functions are combined in the same structure.

Inclusion of a spindle rewind mechanism or spindle attachment/brake mechanism as discussed above is readily incorporated with the vertical orientation of the housing 12 in that any structure extending from or through a sidewall 18 is with respect to a vertical wall of the housing 12. For a horizontal orientation of the housing, such structure may extend through the top wall of the housing (with the bottom wall incorporating the cover 54), or the housing may include a bottom footer or flange section along the bottom wall to accommodate the extending structure.

The housing 12 may be made of any one or combination of suitable rigid materials, including any number of low cost materials, such as plastic, cardboard, paperboard, and so forth. One or more of the housing walls may be substantially transparent so that the rolls of lottery tickets are readily visible by the clerk and the purchasing customer. In other embodiments, the walls may be non-transparent for any number of reasons. For example, it may be desired that the housing walls have a particular color, surface finish, or the like, to provide an aesthetically pleasing item, or a background for any manner of advertising indicia 56 (FIG. 1) applied or printed thereon.

Figure 7:
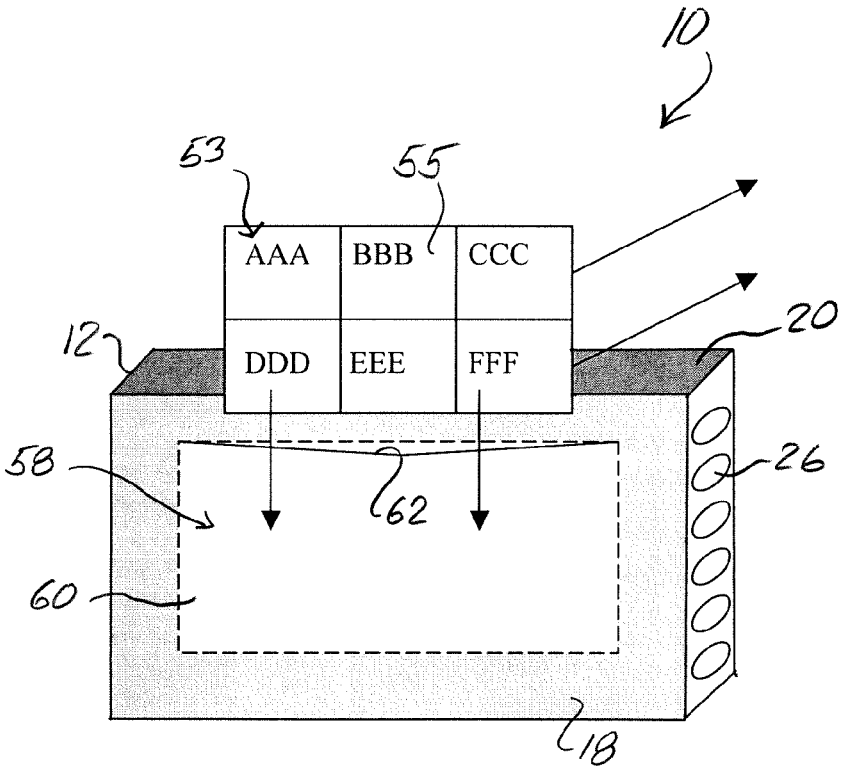
FIG. 7 is a diagrammatic and partial perspective view of an alternative embodiment of a dispensing system in accordance with the invention.

FIG. 7 illustrates an embodiment of a dispenser housing 12 that incorporates a display window 58 for displaying any manner of indicia or graphics inserted therein. The window 58 may be formed by, for example, a transparent material 60 that is attached to the housing sidewall 18 with an open top 62 through which a placard or other item is inserted that advertises the particular lottery tickets within the housing. For example, the placard 53 may be divided into individual sections 55 corresponding to the number of lottery roll positions provided within the housing 12. A sample of each of the respective lottery tickets may be contained at the individual positions 55, or any other means for identifying the individual tickets within the housing. When different lottery ticket rolls are loaded into the housing 12, the placard 53 may be replaced or changed to reflect the different tickets.

The system 10 according to the invention also encompasses the use of any number or manner of remote advertising materials to remotely indicate to consumers the types of lottery tickets contained within the housing. For example, the housing 12 may be disposed at a retail establishment at a location wherein it is not readily visible to consumers, or the housing may be made of a non-transparent material such that the lottery tickets are not visible to the consumer. In this event, it may be desired to place any number of placards at or around the point of purchase of the tickets that advertise the number and types of tickets within the housing 12, as conceptually illustrated by the arrows in FIG. 7.

Figure 4:
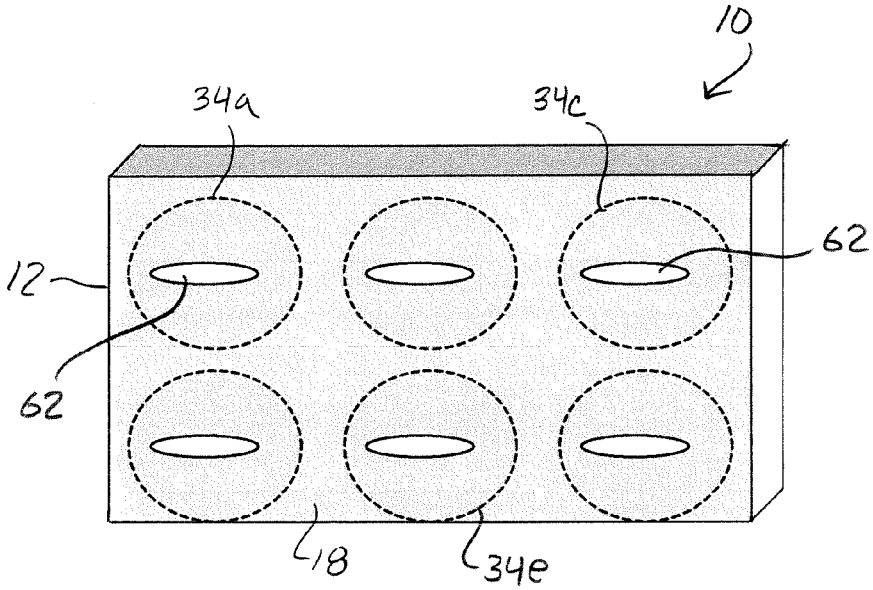
FIG. 4 is a partial perspective back view of a dispenser according to the invention incorporating indication slots in the housing for each of the respective lottery ticket roll positions.

For embodiments wherein the lottery ticket rolls are not readily visible through the housing walls, individual indicator slots 62 (FIG. 4) may be provided at each roll position so that the clerk can readily view at least the sides of the lottery ticket rolls through the indicator slots 62 in order to determine the number of tickets remaining. The indicator slots 62 may have any shape or configuration that adequately displays the depletion of the lottery ticket rolls.

It should be readily appreciated by those skilled in the art that various medications and changes may be made to the embodiments of the invention illustrated and described herein without departing from the scope and spirit of the invention. Such modifications and changes are encompassed by the appended claims.

What is claimed is:

1. A lottery ticket dispensing system, comprising:

a dispenser housing having an internal compartment comprising a plurality of lottery ticket roll positions therein, said housing further comprising an openable cover that upon opening provides simultaneous access to all of said lottery ticket roll positions within said internal compartment;

a plurality of lottery ticket rolls carried within said internal compartment between opposite sidewalls of said housing such that said housing has a dimension between said sidewalls corresponding generally to the width of a single said lottery ticket roll;

at least one wall of said housing defining a common dispensing face with a respective dispensing slot for each of said lottery ticket rolls through which a leading end of each of said lottery ticket rolls is pulled and dispensed independently of said other lottery ticket rolls;

a separate rewind mechanism for each of said lottery ticket rolls configured on an outward face of at least one of said sidewalls;

a plurality of spindles mounted to a side wall of said housing extending into said internal compartment and extending through each of said lottery ticket rolls;

a brake mechanism configured between each spindle and said side wall to prevent freewheeling of the lottery ticket rolls upon dispensing thereof wherein the brake mechanism and rewind mechanism for each lottery roll mechanically engage and control movement of the spindle;

wherein the openable cover is formed in one of the opposite side wails rather than the dispensing face such that when the openable cover is opened the tickets remain in the dispensing slots;

internal walls having a staggered, increasing height from said dispensing face towards an opposite wall of said housing; and wherein said internal walls within said housing separating individual said lottery ticket roll positions within said internal compartment.

2. The dispensing system as in claim 1, wherein said lottery ticket rolls are cureless and freely rotate within said lottery ticket roll positions.

3. The dispensing system as in claim 1, wherein said lottery ticket rolls are arranged in at least two aligned rows within said internal compartment, said housing having a vertical height or horizontal width corresponding generally to twice the diameter of a single said lottery roll, and a depth corresponding generally to the cumulative diameters of said lottery ticket rolls in each said row.

4. The dispensing system as in claim 1, wherein said lottery ticket rolls are arranged in at least two offset rows within said internal compartment, said housing having a vertical height or horizontal width corresponding generally to less than twice the diameter of a single said lottery roll.

5. The dispensing system as in claim 1, wherein said lottery ticket rolls comprise a core that slides onto a respective said spindle.

6. The dispensing system as in claim 5, wherein said spindles are rotationally fixed relative to said sidewall such that said cores rotate relative to said respective spindles.

7. The dispensing system as in claim 6, wherein a sufficient frictional interface is defined between said cores and said spindles to prevent freewheeling of said lottery ticket rolls upon dispensing thereof.

8. The dispensing system as in claim 5, wherein said spindles rotate relative to said sidewall, said cores being rotationally fixed to said spindles.

9. The dispensing system as in claim 8, wherein said rewind mechanism comprises a manually graspable tab configured on an extension of said spindles that extends through said sidewall.

10. The dispensing system as in claim 1, wherein said brake mechanism comprises an adjustable frictional interface between said spindles and said sidewall.

11. The dispensing system as in claim 1, wherein said housing comprises at least one wall made of a substantially transparent material.

12. The dispensing system as in claim 1, wherein said housing comprises any manner of indicia provided thereon to promote or advertise the lottery game.

13. The dispensing system as in claim 1, wherein said housing comprises a display window configured on at least one wall thereof for removable receipt and display of any manner of indicia material.

14. The dispensing system as in claim 1, further comprising a separate display of indicia related to said lottery tickets remote from said housing.

15. The dispensing system as in claim 1, wherein said housing comprises a generally rectangular elongated block configuration, said dispensing face defined on a front edge wall of said block configuration, and said lottery ticket rolls extending between opposite sidewalls of said block configuration.

16. The dispensing system as in claim 1, wherein said housing comprises respective indicator slots defined in a wall thereof for each lottery ticket roll position, said indicator slots configured for external viewing of the decreasing diameter of said lottery ticket rolls as said lottery ticket rolls are dispensed.

17. The dispensing system as in claim 1, further comprising a spindle attachment mechanism that affixes the spindle to the side wall wherein the brake mechanism is integral with the spindle attachment mechanism.

18. The dispensing system as in claim 1, wherein the rewind mechanism and the brake mechanism are combined in the same structure.

19. A lottery ticket dispenser for dispensing multiple rolls of lottery tickets, said dispenser, comprising:

a housing having an internal compartment comprising a plurality of lottery ticket roll positions therein between opposite sidewalls of said housing such that said housing has a dimension between said sidewalls corresponding generally to the width of a single lottery ticket roll, said housing further comprising an openable cover that upon opening provides simultaneous access to all of said lottery tickets roll positions within said internal compartment;

at least one wall of said housing defining a common dispensing face with a respective dispensing slot for each of said lottery ticket roll positions through which a leading end of each lottery ticket roll is pulled and dispensed independently of other lottery ticket rolls;

a separate rewind mechanism for each of said lottery ticket rolls configured on an outward face of at least one of said sidewalls;

a plurality of spindles mounted to a side wall of said housing extending into said internal compartment and extending through each of said lottery ticket rolls;

a brake mechanism configured between each spindle and said side wall to prevent freewheeling of the lottery ticket rolls upon dispensing thereof wherein the brake mechanism and rewind mechanism for each lottery roll mechanically engage and control movement of the spindle;

wherein the openable cover is formed in one of the opposite side wails rather than the dispensing face such when the openable cover is opened the tickets remain in the dispensing slots;

internal walls having a staggered, increasing height from said dispensing face towards an opposite wall of said housing; and wherein said internal walls within said housing separating said individual lottery ticket roll positions within said internal compartment.

20. The dispenser as in claim 19, wherein said lottery ticket roll positions are arranged in at least two aligned rows within said internal compartment.

21. The dispenser as in claim 19, wherein said lottery ticket roll positions are arranged in at least two offset rows within said internal compartment.

22. The dispenser as in claim 19, wherein said spindles are sized for sliding receipt of a lottery ticket roll core thereon.

23. The dispenser as in claim 22, wherein said spindles are rotationally fixed relative to said sidewall such that the cores rotate relative to said respective spindles.

24. The dispenser as in claim 22, wherein said spindles rotate relative to said sidewall.

25. The dispenser as in claim 24, wherein said rewind mechanism comprises a manually graspable tab configured on an extension of said spindles that extends through said sidewall.

26. The dispenser as in claim 19, wherein said brake mechanism comprises an adjustable frictional interface between said spindles and said sidewall.

27. The dispenser as in claim 19, wherein said housing comprises a display window configured on at least one wall thereof for removable receipt and display of any manner of indicia material.

28. The dispenser as in claim 19, wherein said housing comprises respective indicator slots defined in a wall thereof for each lottery ticket roll position, said indicator slots configured for external viewing of the decreasing diameter of said lottery ticket rolls as said lottery ticket rolls are dispensed.

29. The dispenser as in claim 19, further comprising a spindle attachment mechanism that affixes the spindle to the side wall wherein the brake mechanism is integral with the spindle attachment mechanism.

30. The dispenser as in claim 19, wherein the rewind mechanism and the brake mechanism are combined in the same structure.

* * * * *